US011121453B2

(12) United States Patent
Tien et al.

(10) Patent No.: US 11,121,453 B2
(45) Date of Patent: Sep. 14, 2021

(54) ANTENNA AND ELECTRONIC DEVICE

(71) Applicant: ASUSTeK COMPUTER INC., Taipei (TW)

(72) Inventors: Ling Tien, Taipei (TW); Pei-Chuan Huang, Taipei (TW); Pin-Tang Chiu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 16/573,336

(22) Filed: Sep. 17, 2019

(65) Prior Publication Data

US 2020/0106161 A1 Apr. 2, 2020

(30) Foreign Application Priority Data

Sep. 28, 2018 (TW) ..... 107134545

(51) Int. Cl.

| | |
|---|---|
| ***H01Q 1/24*** | (2006.01) |
| ***H01Q 1/36*** | (2006.01) |
| ***H01Q 3/01*** | (2006.01) |
| ***H01Q 3/24*** | (2006.01) |

(52) U.S. Cl.

CPC ..... *H01Q 1/243* (2013.01); *H01Q 1/245* (2013.01); *H01Q 1/364* (2013.01); *H01Q 3/01* (2013.01); *H01Q 3/24* (2013.01)

(58) Field of Classification Search

CPC ..... H01Q 1/081; H01Q 1/082; H01Q 1/241; H01Q 1/242; H01Q 1/243; H01Q 1/245; H01Q 1/246; H01Q 1/247; H01Q 1/248; H01Q 1/364; H01Q 1/366; H01Q 1/368; H01Q 1/273; H01Q 1/276; H01Q 3/01; H01Q 3/24; H01Q 9/42

USPC ..... 343/850

See application file for complete search history.

(56) References Cited

U.S. PATENT DOCUMENTS

| | | | | |
|---|---|---|---|---|
| 5,392,461 | A * | 2/1995 | Yokoyama | H01Q 1/245 361/800 |
| 6,512,496 | B2 * | 1/2003 | Alexeff | H01Q 1/04 343/878 |
| 9,093,749 | B2 | 7/2015 | Tsai et al. | |
| 2013/0021217 | A1 * | 1/2013 | Tsai | H01Q 1/245 343/807 |
| 2014/0078019 | A1 | 3/2014 | Kim et al. | |

(Continued)

FOREIGN PATENT DOCUMENTS

| | | | |
|---|---|---|---|
| CN | 103682593 | A | 3/2014 |
| CN | 103794844 | A | 5/2014 |

(Continued)

*Primary Examiner* — Andrea Lindgren Baltzell

(74) *Attorney, Agent, or Firm* — McClure, Qualey & Rodack, LLP

(57) ABSTRACT

An antenna adapted for an electronic device is provided. The antenna includes a chamber, a first liquid conductor, a second liquid conductor, and a feeding portion. The first liquid conductor is located in the chamber. The second liquid conductor is located in the chamber. A specific gravity of the second liquid conductor is larger than a specific gravity of the first liquid conductor, and a conductivity of the second liquid conductor is smaller than a conductivity of the first liquid conductor. The feeding portion extends into the chamber from an outside of the chamber. The feeding portion contacts with one of the first liquid conductor and the second liquid conductor.

9 Claims, 12 Drawing Sheets

(56) References Cited

U.S. PATENT DOCUMENTS

| | | | | |
|---|---|---|---|---|
| 2014/0145899 | A1 | 5/2014 | Yang et al. | |
| 2016/0226132 | A1* | 8/2016 | Kim | H01Q 1/243 |
| 2020/0028250 | A1* | 1/2020 | Akimoto | H01Q 3/01 |

FOREIGN PATENT DOCUMENTS

| | | | | | |
|---|---|---|---|---|---|
| CN | 106450705 | A | * | 2/2017 | H01Q 1/36 |
| CN | 108123212 | A | | 6/2018 | |
| JP | 2002-359510 | A | * | 12/2002 | H01Q 1/08 |
| JP | 359510 | A | * | 12/2002 | H01Q 1/08 |
| KR | 20070007619 | A | | 1/2007 | |
| TW | 200700231 | A | | 1/2007 | |
| TW | 01415711 | A | * | 10/2012 | H01Q 3/00 |
| TW | 201306378 | A | | 2/2013 | |
| TW | 201415711 | A | * | 4/2014 | H01Q 3/00 |
| TW | 201421792 | A | | 6/2014 | |

* cited by examiner

ANTENNA AND ELECTRONIC DEVICE

CROSS-REFERENCE TO RELATED APPLICATION

This application claims the priority benefit of Taiwan Application Serial No. 107134545, filed on Sep. 28, 2018. The entirety of the above-mentioned patent application is hereby incorporated by reference herein and made a part of specification

BACKGROUND OF THE INVENTION

Field of the Invention

The disclosure relates to an antenna technology, and in particular, to an antenna made of a liquid conductor and an electronic device including the antenna made of the liquid conductor.

Description of the Related Art

With progress and development of science and technology, electronic devices are becoming increasingly popular. In order to meet demands of the public, electronic devices usually equip with wireless communication functions, which extend to more diversified applications.

However, in recent years, researches show that electromagnetic waves generated by an electronic device during use causes an intangible damage to a user. In addition, a user cannot avoid being exposed in an environment in which electromagnetic waves are generated during use of all current electronic devices. In particular, most of the current electronic devices are designed to be light and thin, and consequently an antenna for transmitting electromagnetic waves is relatively much closer to a human body, exacerbating an influence of electromagnetic waves on human health.

BRIEF SUMMARY OF THE INVENTION

According to the first aspect of the disclosure, an antenna adapted for an electronic device is provided. The antenna includes a chamber; a first liquid conductor located in the chamber; a second liquid conductor located in the chamber, wherein a specific gravity of the second liquid conductor is larger than a specific gravity of the first liquid conductor, and a conductivity of the second liquid conductor is smaller than a conductivity of the first liquid conductor; and a feeding portion extending into the chamber from an outside of the chamber and contacting one of the first liquid conductor or the second liquid conductor.

According to the second aspect of the disclosure, an electronic device is provided. The electronic device includes a frame; and an antenna located in the frame, the antenna comprising: a chamber; a first liquid conductor, located in the chamber; a second liquid conductor, located in the chamber, wherein a specific gravity of the second liquid conductor is larger than a specific gravity of the first liquid conductor, and a conductivity of the second liquid conductor is smaller than a conductivity of the first liquid conductor; and a feeding portion, extending into the chamber from an outside of the chamber and contacting one of the first liquid conductor and the second liquid conductor.

Through application of the liquid conductors, regardless of the antenna being in a tilted state during use, a displacement direction of the antenna changing, or even the antenna swinging, the second liquid conductor with a lower radiation capability is still located under the first liquid conductor with a stronger radiation capability following a gravity traction, so that a radiation pattern of the antenna faces upward roughly. In addition, because the conductivity of the second liquid conductor is relatively low, an amount of radiation received by a user is reduced, thereby improving user safety.

Specific features and advantages of the disclosure are described in detail in the following embodiments, whose content is sufficient to enable anyone skilled in the related art to understand and hereby implement the technical content of the disclosure. In addition, according to the disclosure, claims, and drawings of the description, those skilled in the related art would understand related purposes and advantages of the disclosure easily.

DETAILED DESCRIPTION OF THE EMBODIMENTS

Figure 1:
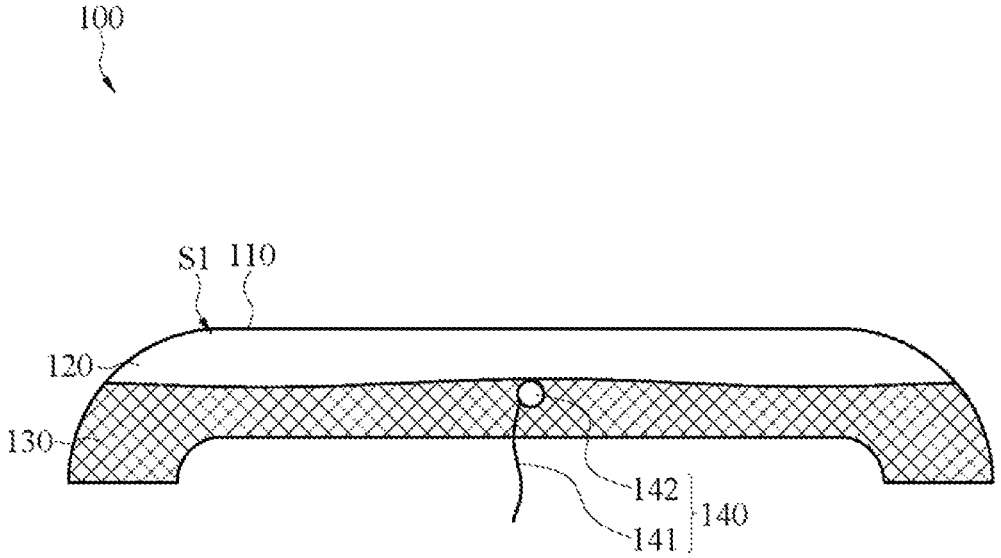
FIG. 1 is a schematic outline diagram of an embodiment of an antenna.
Figure 2:
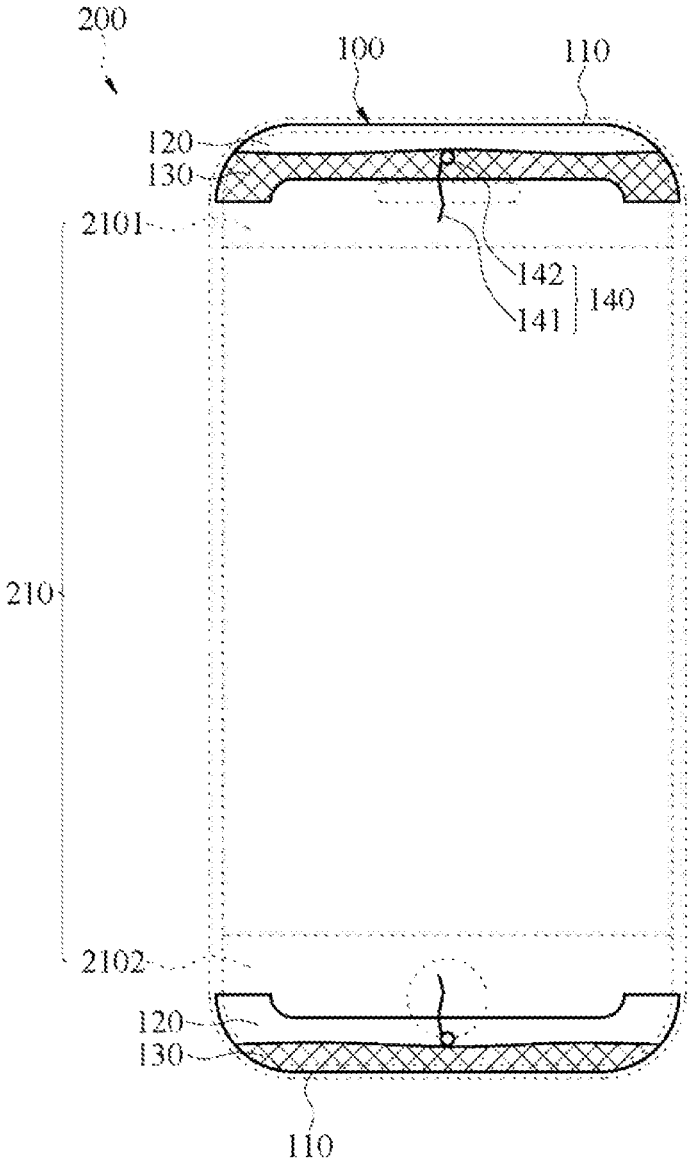
FIG. 2 is a schematic outline diagram of an embodiment of an electronic device.
Figure 3:
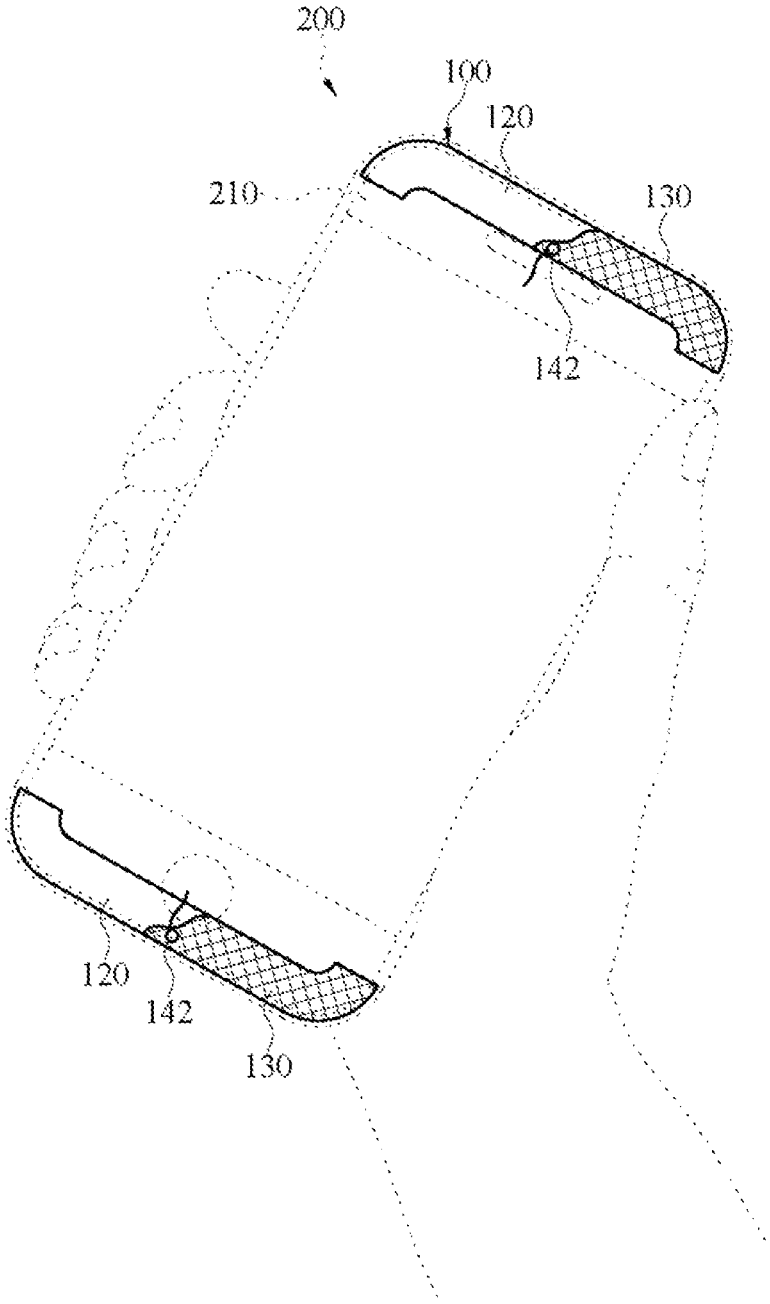
FIG. 3 is a schematic outline diagram of distribution of liquid conductors of an antenna when a user operates an electronic device.
Figure 4:
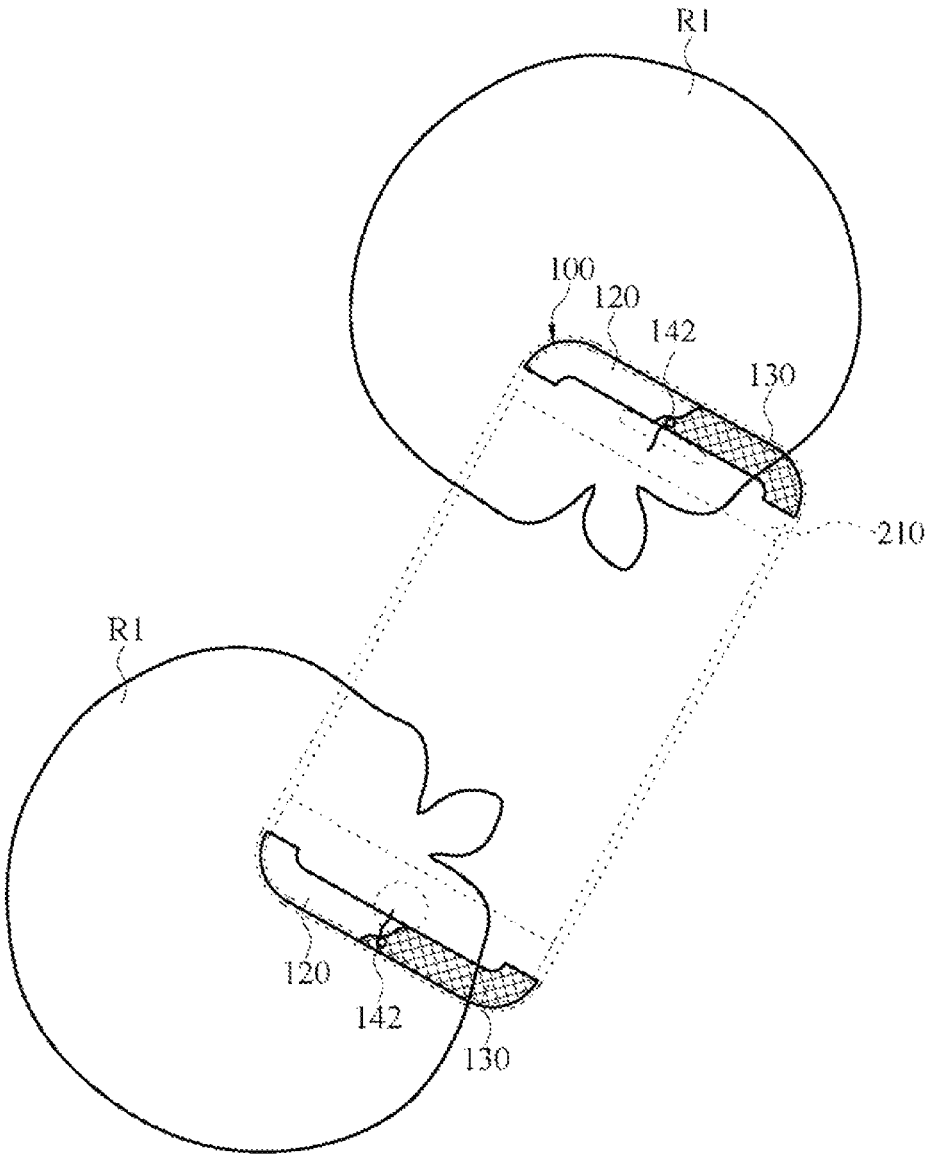
FIG. 4 is a schematic outline diagram of a radiation pattern of an embodiment when an electronic device (antenna) is upright and tilted rightward.
Figure 5:
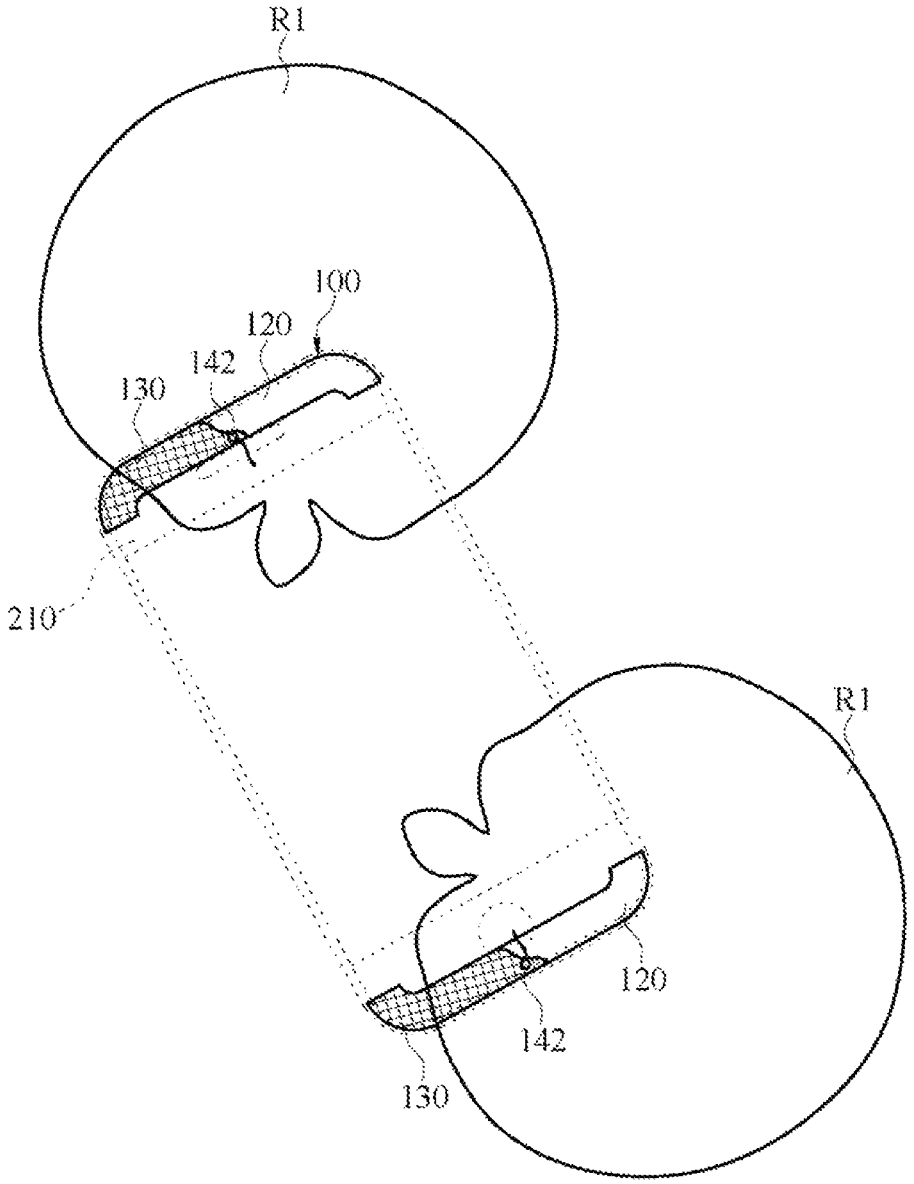
FIG. 5 is a schematic outline diagram of a radiation pattern of an embodiment when an electronic device (antenna) is upright and titled leftward.
Figure 6:
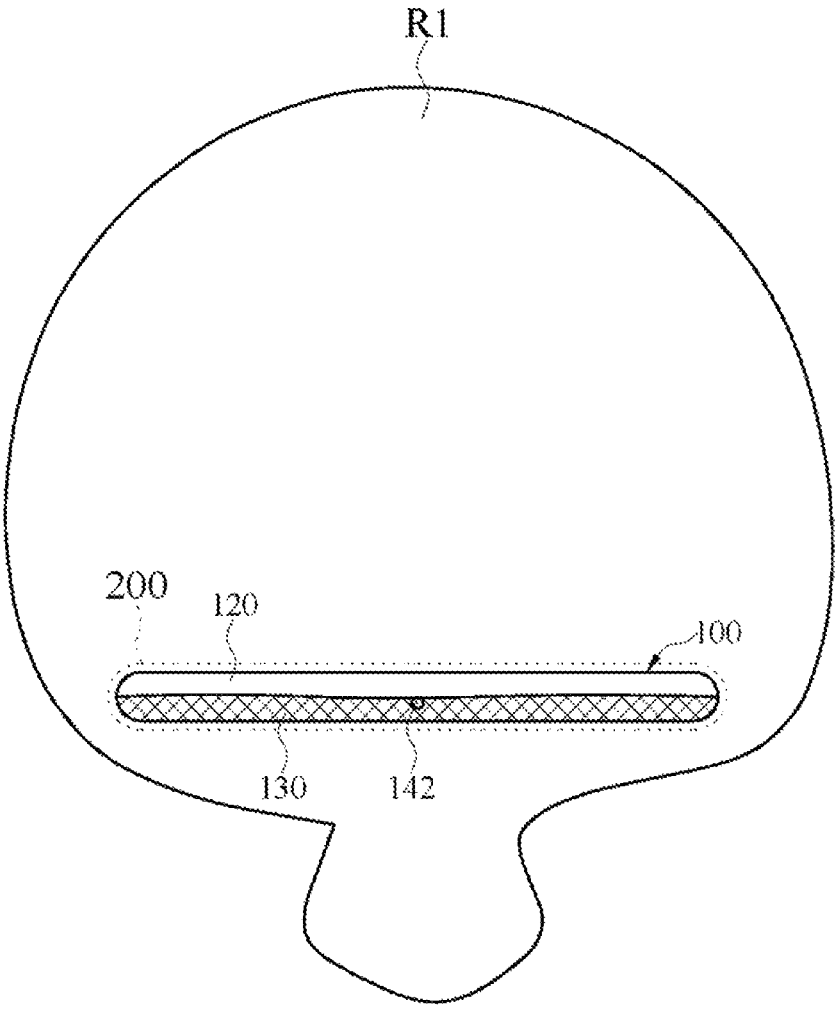
FIG. 6 is a schematic outline diagram of a radiation pattern of an embodiment when an electronic device (antenna) is laid flat.
Figure 7:
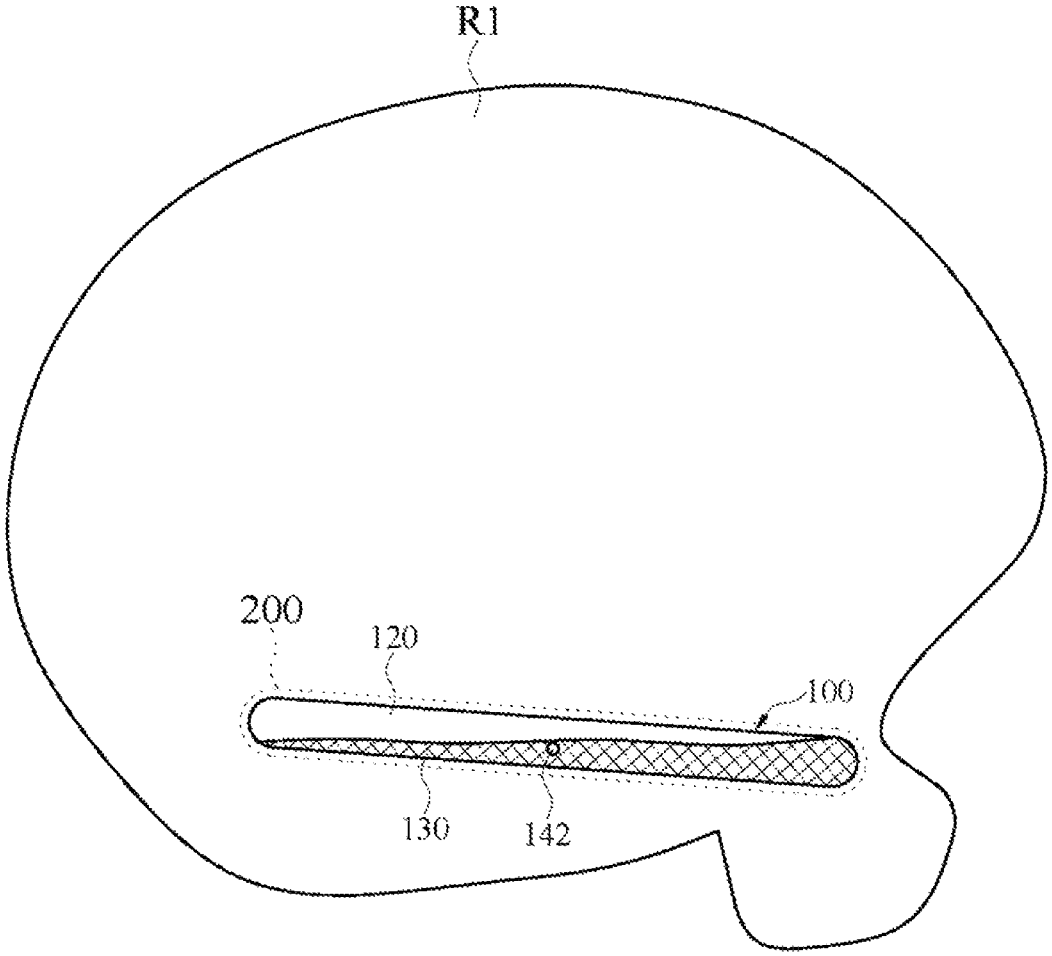
FIG. 7 is a schematic outline diagram of a radiation pattern of an embodiment when an electronic device (antenna) is laid flat and tilted rightward.
Figure 8:
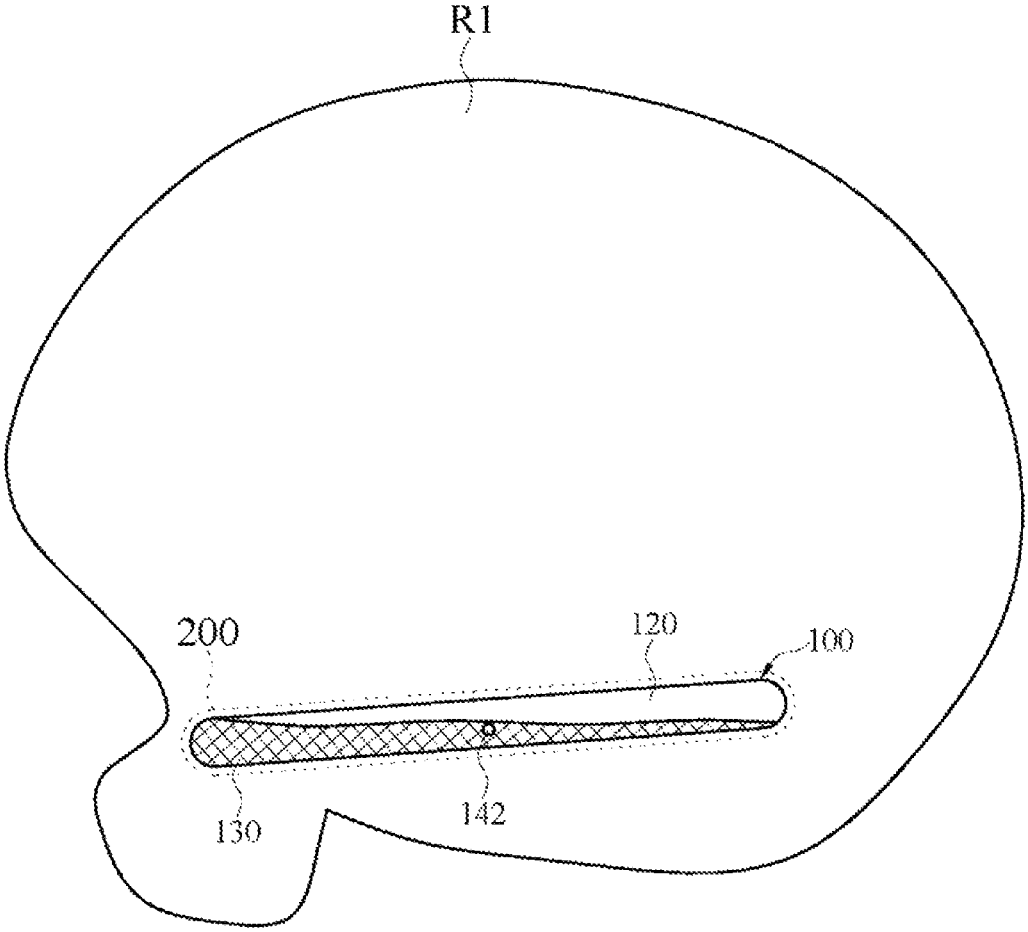
FIG. 8 is a schematic outline diagram of a radiation pattern of an embodiment when an electronic device (antenna) is laid flat and tilted leftward.

FIG. 1 is a schematic outline diagram of an embodiment of an antenna. Referring to FIG. 1, an antenna 100 of the disclosure includes at least two types of liquid conductors, and specific gravities and conductivities of these liquid conductors are different from each other, thereby dynamically configuring a radiation pattern R1 of the antenna 100, according to gravity traction. In an embodiment, the antenna 100 includes a chamber 110, a first liquid conductor 120, a second liquid conductor 130, and a feeding portion 140.

The chamber 110 includes enclosed accommodation space S1. In an embodiment, a housing of the chamber 110 is a rectangle, a cylinder, or any other arbitrary suitable shape. In addition, the accommodation space S1 of the chamber 110 is a rectangle, a cylinder, or any other arbitrary suitable shape. Moreover, a size of the chamber 110 and a size of the accommodation space S1 inside the chamber, such as a thickness, a length, a width, a height of the housing of the chamber 110, is determined according to an effect the antenna 100 needs to provide and implementation costs thereof.

In an embodiment, the chamber 110 is formed of a conductive film and is elastic or flexible. In an embodiment, the conductive film is indium tin oxide (ITO) or indium zinc oxide (IZO), etc. However, in another embodiment, the chamber 110 is formed of one or more medium materials. In an embodiment, the medium material is plastics, silicone, etc.

The first liquid conductor 120 and the second liquid conductor 130 are disposed in the accommodation space S1 of the chamber 110, and the first liquid conductor 120 and the second liquid conductor 130 flow in the accommodation space S1 of the chamber 110 according to a gravity traction. The first liquid conductor 120 and the second liquid conductor 130 are insoluble with each other and do not chemically react with each other.

A specific gravity of the second liquid conductor 130 is larger than a specific gravity of the first liquid conductor 120, so that the first liquid conductor 120 floats on the second liquid conductor 130. Moreover, a conductivity of the second liquid conductor 130 is smaller than a conductivity of the first liquid conductor 120. In other words, the first liquid conductor 120 includes more free electrons than the second liquid conductor 130. Therefore, when energy is fed from the feeding portion 140, more electrons of the first liquid conductor 120 move to form a higher current density, and a radiation intensity generated by the first liquid conductor 120 is stronger than that generated by the second liquid conductor 130. Therefore, an intensity, a position, an angle, and a direction of the radiation pattern R1 of the antenna 100 varies correspondingly with flowing of the first liquid conductor 120 and the second liquid conductor 130. Therefore, it is to be noted that, although the conductivity of the second liquid conductor 130 is lower than that of the first liquid conductor 120, the second liquid conductor still has a radiation capability.

Referring to FIG. 2 to FIG. 8, through application of the liquid conductors, regardless of a state of the antenna 100 during use (for example: the antenna 100 becomes tilted or e swings by an external force), the second liquid conductor 130 with a lower radiation capability is still located under the first liquid conductor 120 with a stronger radiation capability according to a gravity traction, so that the radiation pattern R1 of the antenna 100 almost faces upward.

Generally, since most of signal relay stations in wireless communication, such as a wireless base station and a wireless access point, are disposed at a relatively high place, the radiation pattern R1 of the antenna 100 of the disclosure aims at the wireless base station and the wireless access point more effectively and intensively without being affected by a using state of the antenna 100. In addition, when a user operates an electronic device 200 installed with the antenna 100 of the disclosure, the liquid conductors in the antenna 100 moves due to a gravity traction, and a position of the liquid conductor in the antenna 100 closes to a human body is the second liquid conductor 130 due to a relatively large specific gravity as well as the conductivity of the second liquid conductor 130 is relatively low, an amount of radiation received by the user from the antenna 100 is thus reduced.

The feeding portion 140 is electrically conductive and is configured to receive a feeding signal. The feeding portion 140 extends into the accommodation space S1 from an outside of the chamber 110, and the feeding portion 140 contacts one of the first liquid conductor 120 or the second liquid conductor 130 to feed the feeding signal to a liquid conductor which contacts the feeding portion. The feeding portion 140 swings with flowing of the first liquid conductor 120 when the feeding portion 140 contacts the first liquid conductor 120 or the feeding portion 140 swings with flowing of the second liquid conductor 130 when the feeding portion 140 contacts the second liquid conductor 130, so that the feeding signal is fed into a same liquid conductor continuously.

In an embodiment, the feeding portion 140 contacts a liquid conductor with a lower conductivity among these liquid conductors, so that the electric charges move from the liquid conductor with a lower conductivity to a liquid conductor with a higher conductivity to form a charge flow during feeding of the feeding signal. In an embodiment, the feeding portion 140 contacts the second liquid conductor 130 with a lower conductivity.

In an embodiment, the feeding portion 140 includes a feeding line 141 and a feeding body 142. The feeding body 142 is a conductor and is roughly spherical. The feeding body 142 is located in the accommodation space S1 of the chamber 110, and floats on a liquid conductor to feed the feeding signal into the liquid conductor. A partial section of the feeding line 141 extends into the accommodation space S1 from the outside of the chamber 110 and connects with the feeding body 142 to pull the feeding body 142. In some embodiments, the feeding line 141 is a wire with an outside insulating material.

In an embodiment, a specific gravity of the feeding body 142 is determined according to a specific gravity of the liquid conductor which the feeding signal is to be fed into. In an embodiment, when the feeding signal is to be fed into the second liquid conductor 130 with a larger specific gravity, the specific gravity of the feeding body 142 is larger than a specific gravity of the second liquid conductor 130.

In an embodiment, the feeding line 141 of the feeding portion 140 extends from the outside of the chamber 110 into a central section of the chamber 110. In other embodiment, as long as the feeding body 142 of the feeding portion 140 contacts a liquid conductor which the feeding portion want to contact, the feeding line 141 can extend into the accommodation space S1 from any suitable position of the chamber 110.

In an embodiment, since the antenna 100 includes a function of transforming the radiation pattern R1, the antenna 100 is provided with only one feeding portion 140. In other embodiment, the number of feeding portions 140 is determined by demand.

In some embodiments, a percentage between a volume of the first liquid conductor 120 and a total volume of the first liquid conductor 120 and the second liquid conductor 130 is approximately greater than or equal to 30%. Therefore, the antenna 100 contains a sufficient amount of first liquid conductors 120 to achieve the radiation pattern R1 of the antenna 100 varies according to a gravity traction, and the radiation pattern R1 of the antenna 100 almost faces upward. A relationship formula is shown as follows:

$$\frac{V_1}{V_1 + V_2}\ \% \geq 30\%,$$

where $V_1$ is the volume of the first liquid conductor 120, and $V_2$ is a volume of the second liquid conductor 130.

Figure 9:
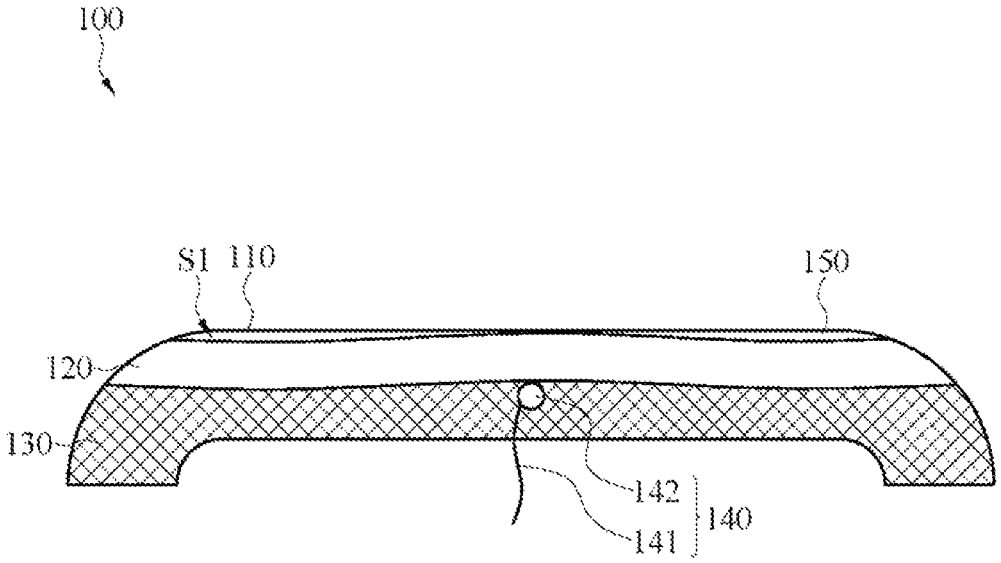
FIG. 9 is a schematic outline diagram of an embodiment of an antenna.

FIG. 9 is a schematic outline diagram of an embodiment of an antenna. Referring to FIG. 1 to FIG. 9, in some embodiments, the antenna 100 further includes gas medium 150, the gas medium 150 fills in the accommodation space S1 of the chamber 110. Therefore, the first liquid conductor 120 and the second liquid conductor 130 is hermetically sealed in the accommodation space S1 of the chamber 110, so that the first liquid conductor 120 and the second liquid conductor 130 flows in the accommodation space S1 of the chamber 110 according to the gravity traction. In other words, a volume of the accommodation space S1 of the chamber 110 is larger than the total volume of the first liquid conductor 120 and the second liquid conductor 130.

In an embodiment, the gas medium 150 is air. In other embodiment, the gas medium 150 is inert gas, such as helium, neon, or argon, etc., to reduce a possibility that a chemical reaction occurs in the accommodation space S1 of the chamber 110.

Figure 10:
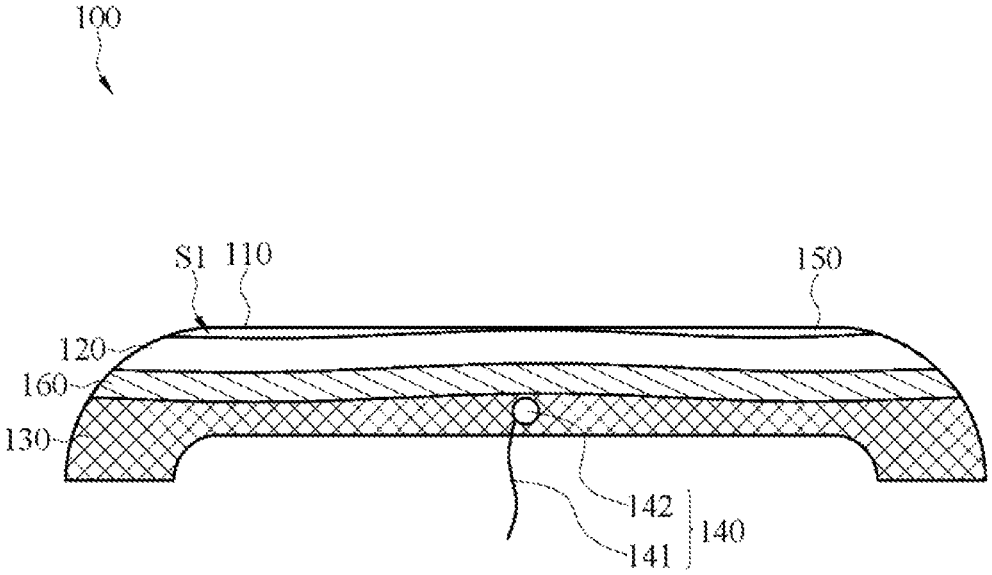
FIG. 10 is a schematic outline diagram of an embodiment of an antenna.

FIG. 10 is a schematic outline diagram of an embodiment of an antenna. Referring to FIG. 1 to FIG. 10, in some embodiments, the antenna 100 further includes a third liquid conductor 160. The third liquid conductor 160 is disposed in the accommodation space S1 of the chamber 110, the third liquid conductor 160, the first liquid conductor 120, and the second liquid conductor 130 flows in the accommodation space S1 of the chamber 110 according to the gravity traction. The first liquid conductor 120, the second liquid conductor 130, and the third liquid conductor 160 are insoluble with each other and do not chemically react with each other.

A specific gravity of the third liquid conductor 160 is different from the specific gravity of the first liquid conductor 120 and the specific gravity of the second liquid conductor 130. Moreover, a conductivity of the third liquid conductor 160 is also different from the conductivity of the first liquid conductor 120 and the conductivity of the second liquid conductor 130.

In an embodiment, when the third liquid conductor 160 is located below the second liquid conductor 130 because the specific gravity of the third liquid conductor 160 is larger than the specific gravity of the second liquid conductor 130, the conductivity of the third liquid conductor 160 is lower than the conductivity of the second liquid conductor 130, to reduce an amount of downward radiation from the antenna 100, thereby reducing influence of the radiation of the antenna 100 on a human body. In another embodiment, when the specific gravity of the third liquid conductor 160 is between the specific gravity of the first liquid conductor 120 and the specific gravity of the second liquid conductor 130, or even smaller than the specific gravity of the first liquid conductor 120, the conductivity of the third liquid conductor 160 is greater than the conductivity of the second liquid conductor 130, and whether the conductivity of the third liquid conductor 160 is greater than the conductivity of the first liquid conductor 120 is determined according to a design of the antenna 100. In other words, among all liquid conductors in the accommodation space S1 of the chamber 110, a conductivity of a liquid conductor is lower than the conductivities of other liquid conductors because the specific gravity of the liquid conductor is larger than the specific gravities of other liquid conductors.

In some embodiments, a percentage between the volume of the first liquid conductor 120 and a total volume of the first liquid conductor 120, the second liquid conductor 130, and the third liquid conductor 160 is approximately greater than or equal to 30%. Therefore, the antenna 100 contains a sufficient amount of first liquid conductors 120 to achieve that the radiation pattern R1 of the antenna 100 varies according to a gravity traction, and the radiation pattern R1 of the antenna 100 almost faces upward. A relationship formula is shown as follows:

$$\frac{V_1}{V_1 + V_2 + V_3}\ \% \geq 30\%,$$

where $V_1$ is the volume of the first liquid conductor 120, $V_2$ is the volume of the second liquid conductor 130, and $V_3$ is a volume of the third liquid conductor 160.

In some embodiments, the first liquid conductor 120, the second liquid conductor 130, and the third liquid conductor 160 is selected from gallium, gallium compounds, cesium, cesium compounds, magnesium, and magnesium compounds, etc. respectively.

The antenna 100 of any embodiment of the disclosure is disposed in an electronic device 200, so that the electronic device 200 performs wireless communication through the antenna 100. In an embodiment, the electronic device 200 includes a frame 210. The frame 210 is configured to shield various assemblies in the electronic device 200. The antenna 100 is disposed in the frame 210 of the electronic device 200 to be hidden in the frame 210.

In some embodiments, at least one antenna 100 is disposed in the electronic device 200.

Figure 11:
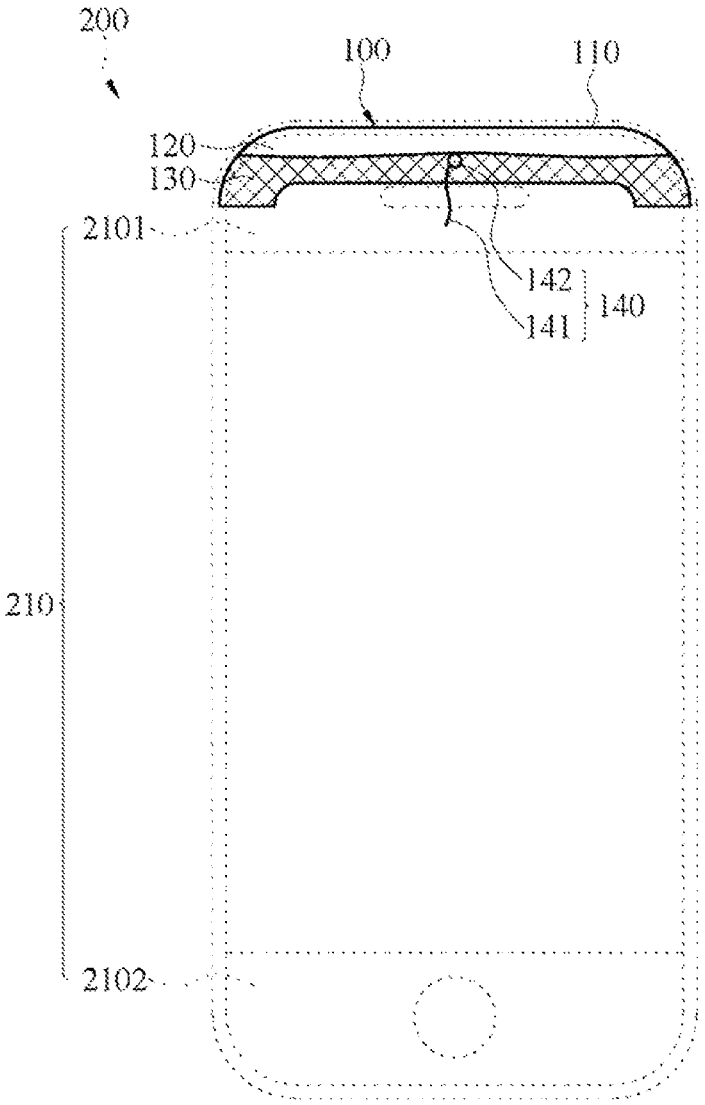
FIG. 11 is a schematic outline diagram of an embodiment in which an antenna is disposed in an upper frame.
Figure 12:
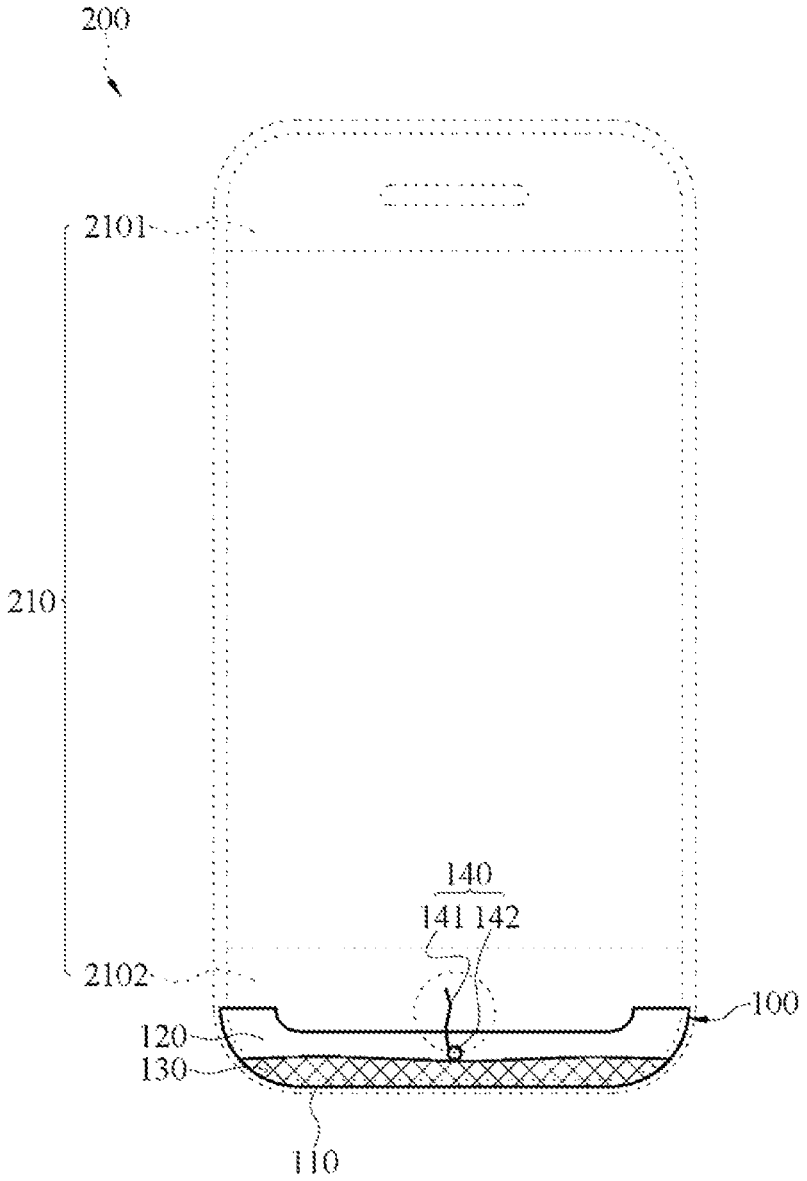
FIG. 12 is a schematic outline diagram of an embodiment in which an antenna is disposed in a lower frame.

In some embodiments, the frame 210 includes two ends opposite each another. The two ends are referred to as an upper end and a lower end respectively. In addition, the frame 210 includes an upper frame 2101 and a lower frame 2102. The upper frame 2101 is located at the upper end of the frame 210, and the lower frame 2102 is located at the lower end of the frame 210. As shown in FIG. 11, in an embodiment, the antenna 100 is disposed in the upper frame 2101 and hidden in the upper frame 2101. In another embodiment, the antenna 100 is disposed in the lower frame 2102 and hidden in the lower frame 2102. As shown in FIG. 12, in the embodiment, when there are two antennas 100, the two antennas 100 is disposed in the upper frame 2101 and the lower frame 2102 of the electronic device 200 respectively.

In some embodiments, the frame 210 of the electronic device 200 is made of a metal material, to reduce a clearance area required for the antenna 100, and an appearance of the electronic device 200 is more aesthetically pleasing without gap. In other embodiments, only a place, at which the antenna 100 is disposed, of the upper frame 2101 or the lower frame 2102 is made of a metal material.

In some embodiments, the electronic device 100 is a mobile device.

In summary, the antenna and the electronic device in embodiments of the disclosure configure a radiation pattern dynamically in response to a gravity traction using different gravities and conductivities of the two liquid conductors, so that the radiation pattern faces upward roughly, thereby aiming at a signal relay station effectively and intensively, and effectively reducing the radiation impact to a user.

Although the technical content of the disclosure is provided above in preferred embodiments, the technical content is not intended to limit the disclosure. Some changes and modifications made by anyone skilled in the art without departing from a spirit of the disclosure shall fall within the disclosure. Therefore, of protection scope of the disclosure shall be subject to that defined by attached claims.

What is claimed is:

1. An antenna applied to an electronic device, the antenna comprising:

a chamber;

a first liquid conductor, located in the chamber;

a second liquid conductor, located in the chamber and in direct contact with the first liquid conductor, wherein a specific gravity of the second liquid conductor is larger than a specific gravity of the first liquid conductor, and a conductivity of the second liquid conductor is smaller than a conductivity of the first liquid conductor; and a feeding portion, extending into the chamber from an outside of the chamber and contacting one of the first liquid conductor or the second liquid conductor;

wherein the feeding portion moves with flowing of the first liquid conductor when the feeding portion contacts the first liquid conductor, or the feeding portion moves with flowing of the second liquid conductor when the feeding portion contacts the second liquid conductor.

2. The antenna according to claim 1, wherein a percentage between a volume of the first liquid conductor and a total volume of the first liquid conductor and the second liquid conductor is greater than or equal to 30%.

3. The antenna according to claim 1, further comprising:

a gas medium, existing in the chamber.

4. The antenna according to claim 1, further comprising:

a third liquid conductor, located in the chamber, wherein a specific gravity of the third liquid conductor is different from the specific gravity of the second liquid conductor and the specific gravity of the first liquid conductor, and a conductivity of the third liquid conductor is different from the conductivity of the second liquid conductor and the conductivity of the first liquid conductor.

5. The antenna according to claim 4, wherein when the specific gravity of the third liquid conductor is larger than the specific gravity of the second liquid conductor, the conductivity of the third liquid conductor is smaller than the conductivity of the second liquid conductor.

6. The antenna according to claim 4, wherein a percentage between a volume of the first liquid conductor and a total volume of the first liquid conductor, the second liquid conductor, and the third liquid conductor is greater than or equal to 30%.

7. The antenna according to claim 1, wherein the chamber is made of a conductive film.

8. An electronic device, comprising:

a frame; and an antenna located in the frame, the antenna comprising:

a chamber;

a first liquid conductor, located in the chamber;

a second liquid conductor, located in the chamber and in direct contact with the first liquid conductor, wherein a specific gravity of the second liquid conductor is larger than a specific gravity of the first liquid conductor, and a conductivity of the second liquid conductor is smaller than a conductivity of the first liquid conductor; and a feeding portion, extending into the chamber from an outside of the chamber and contacting one of the first liquid conductor and the second liquid conductors;

wherein the feeding portion moves with flowing of the first liquid conductor when the feeding portion contacts the first liquid conductor, or the feeding portion moves with flowing of the second liquid conductor when the feeding portion contacts the second liquid conductor.

9. The electronic device according to claim 8, wherein the frame comprises an upper frame and a lower frame, the upper frame and the lower frame being located at two opposite ends of the frame respectively, and wherein the antenna is disposed in the upper frame or the lower frame.

* * * * *